US010046563B2

(12) United States Patent
Nakayama

(10) Patent No.: US 10,046,563 B2
(45) Date of Patent: Aug. 14, 2018

(54) LIQUID JET HEAD, METHOD OF MANUFACTURING LIQUID JET HEAD, AND LIQUID JET DEVICE

(71) Applicant: SII Printek Inc., Chiba-shi, Chiba (JP)

(72) Inventor: Hitoshi Nakayama, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 15/353,055

(22) Filed: Nov. 16, 2016

(65) Prior Publication Data

US 2017/0151785 A1 Jun. 1, 2017

(30) Foreign Application Priority Data

Nov. 27, 2015 (JP) ..... 2015-232245

(51) Int. Cl.

| | |
|---|---|
| ***B41J 2/14*** | (2006.01) |
| ***B41J 2/16*** | (2006.01) |
| ***C23C 18/16*** | (2006.01) |
| ***C23C 18/22*** | (2006.01) |
| ***C23C 18/18*** | (2006.01) |

(52) U.S. Cl.

CPC ..... *B41J 2/14201* (2013.01); *B41J 2/1607* (2013.01); *B41J 2/1609* (2013.01); *B41J 2/1623* (2013.01); *B41J 2/1626* (2013.01); *B41J 2/1631* (2013.01); *B41J 2/1632* (2013.01); *B41J 2/1643* (2013.01); *C23C 18/1608* (2013.01); *C23C 18/1633* (2013.01); *C23C 18/1893* (2013.01); *C23C 18/22* (2013.01)

(58) Field of Classification Search

CPC ..... B41J 2/175; B41J 2/14233; B41J 2/1623; B41J 2/1632; B41J 2/1631; B41J 2/161; B41J 2/1609; B41J 2/1643; B41J 2/1626; B41J 2/14201; B41J 2/1607

USPC ..... 347/20, 54, 68, 71

See application file for complete search history.

(56) References Cited

U.S. PATENT DOCUMENTS

| | | | | |
|---|---|---|---|---|
| 8,727,507 | B2 * | 5/2014 | Fukada | B41J 2/14274 347/71 |
| 2012/0038711 | A1 | 2/2012 | Suzuki | 347/47 |
| 2013/0002769 | A1 * | 1/2013 | Koseki | B41J 2/1609 347/71 |

FOREIGN PATENT DOCUMENTS

| | | |
|---|---|---|
| JP | 10244668 | 9/1998 |
| JP | 10244677 | 9/1998 |
| JP | 11216860 | 8/1999 |
| JP | 2012035607 | 2/2012 |

* cited by examiner

*Primary Examiner* — Jannelle M Lebron
(74) *Attorney, Agent, or Firm* — Adams & Wilks

(57) ABSTRACT

A liquid jet head includes a partition separating adjacent grooves, a lower substrate fixing a lower portion of the partition, and an upper substrate installed on an upper end surface of the partition. The partition includes an electrode layer on a surface lower than the upper end surface, the electrode layer including an outer surface approximately perpendicular to the upper end surface, the outer surface continuing to the upper end surface through a first convex curved surface curving outward.

14 Claims, 7 Drawing Sheets

LIQUID JET HEAD, METHOD OF MANUFACTURING LIQUID JET HEAD, AND LIQUID JET DEVICE

BACKGROUND

Technical Field

The present invention relates to a liquid jet head, a method of manufacturing a liquid jet head, and a liquid jet device that injects droplets to a recording medium to carry out recording.

Related Art

In recent years, liquid jet heads in an inkjet system, which discharge ink droplets to a recording sheet or the like to record letters and figures, or discharge a liquid material to a surface of an element substrate to form a functional thin film, are used. In this system, an ink or a liquid such as a liquid material is supplied from a liquid tank to a channel of the liquid jet head through a supply pipe, and pressure is applied to the liquid in the channel and the liquid is discharged through a nozzle communicating into the channel as droplets. In discharging the droplets, the liquid jet head or a recording medium is moved, and the letters and figures are recorded, or the functional thin film or a three-dimensional structure in a predetermined shape is formed.

For example, JP 10-244668 A describes this sort of a method of manufacturing a liquid jet head. In a first manufacturing method, first, an ink passage made of a plurality of grooves is formed in a surface of a piezoelectric substrate. Next, an electrode is formed on inner surfaces of the grooves and an upper end surface of a partition between the grooves by an evaporation method or a plating method. Next, a photoresist film is applied to the entire surfaces of the inner surfaces of the grooves and the upper end surface of the partition. Next, the photoresist film on the upper end surface of the partition is removed by exposure development. In removing the photoresist film, the photoresist is left on an outer peripheral portion of the upper end surface of the partition. Next, the electrode is etched, and the electrode exposed on the upper end surface of the partition is removed. Then, a glass cover is installed on the upper end surface of the partition, and a nozzle plate is installed on a side surface of the piezoelectric substrate to which the grooves are open, whereby a liquid jet head is completed.

In a second manufacturing method, first, a photoresist film is applied to a surface of a piezoelectric substrate. Next, an ink passage made of a plurality of grooves is formed in a surface of the piezoelectric substrate. Next, the photoresist film on the upper end surface of the partition is removed by exposure development. In removing the photoresist film, the photoresist film is left on an outer peripheral portion of the upper end surface of the partition. Next, an electrode is formed on inner surfaces of the grooves and the upper end surface of the partition. Next, the photoresist film is removed, and the electrode deposited on an upper surface of the photoresist film by a lift-off method. Next, a glass cover is installed on the upper end surface of the partition, and a nozzle plate is installed on a side surface of the piezoelectric substrate to which the grooves are open, whereby a liquid jet head is completed.

JP 10-244677 A describes a method of manufacturing a liquid jet head, for forming an electrode on a side surface of a partition by an electroless plating method. First, a photoresist film is formed on an upper surface of a piezoelectric substrate. Next, a plurality of grooves is formed in a surface of the piezoelectric substrate. A partition is formed between the groove and the groove. Next, a sensitizing-activation step is carried out as pretreatment of electroless plating. First, Sn is absorbed by inner surfaces of the grooves (side surfaces of the partition) and a surface of the photoresist film. Next, the piezoelectric substrate on which Sn is absorbed is immersed in a liquid containing silver nitrate and Sn is replaced with Ag. Next, the piezoelectric substrate is immersed in a solution containing palladium chloride, and Ag is replaced with Pd. Next, the photoresist film is removed from the upper surface of the piezoelectric substrate. Next, an electrode is formed on the surface of the substrate on which Pd is absorbed as a catalyst core by an electroless plating method. The catalyst core does not exist on the surface of the piezoelectric substrate (the upper end surface of the partition) and thus a plated layer is not formed, and the catalyst core exists on the inner surfaces of the grooves (the side surfaces of the partition) and thus the plated layer is formed.

JP 2012-35607 A describes a structure of a principal portion of a liquid jet head. The principal portion of the liquid jet head includes an insulating substrate, partitions made of a piezoelectric member and arranged on the insulating substrate across an ink pressure chamber, and a nozzle plate including a nozzle hole facing the ink pressure chamber and glued to an upper end surface of the partition through an adhesive. A corner portion of the partition between a side surface on a side of the ink pressure chamber and the upper end surface to which the nozzle plate is glued is chamfered into a recessed shape. To be specific, a surface of the insulating substrate and the side surface of the partition are approximately perpendicular to each other, and a chamfered portion of the partition, that is, the corner portion that connects the side surface and the upper end surface of the partition is chamfered into the recessed shape. Next, an electrode is formed on the entire surface of an exposed surface of the partition. Next, the electrode on the upper end surface of the partition is removed.

Next, the nozzle plate is glued to the upper end surface of the partition through an adhesive. In this way, a recessed portion is formed in the corner portion between the side surface and the upper end surface of the partition, and the adhesive overflowing from between the upper end surface and the nozzle plate is accommodated in the recessed portion, so that the adhesive is prevented from flowing into the nozzle plate.

In the first manufacturing method described in JP 10-244668 A, the electrode is formed on the inner surfaces of the grooves of the piezoelectric substrate and the upper end surface of the partition between the groove and the groove, and next, the photoresist film is applied. That is, the photoresist film is applied to the surface on which the partition is arrayed and having a large unevenness difference, and thus a film thickness of the photoresist film becomes ununiform, and the photoresist film on the upper end surface of the partition cannot be highly accurately patterned. As a result, an electrode pattern with a uniform width cannot be formed on the outer peripheral portion of the upper end surface, and poor pattern such as the electrode being removed up to the side surface of the partition is more likely to occur. Further, in the second manufacturing method, the electrode is formed on the upper end surface of the partition, and the patterning is carried out by the lift-off method. Therefore, burr is more likely to occur in an edge portion of the electrode, and the burr is separated in an assembly step and becomes a cause to decrease a manufacturing yield.

Further, in the method described in JP 10-244677 A, the electrode pattern is formed in the corner portion between the side surface and the upper end surface of the partition. Therefore, the electrode in the corner portion is easily lacked or comes off, and becomes a cause to decrease the manufacturing yield. Further, the catalyst core is absorbed by the surface of the piezoelectric substrate on which the photoresist film is formed. However, the photoresist film has a water-repellent property, and thus repels the palladium chloride solution, and transfer of a fine pattern on the photoresist film to the pattern of the catalyst core is difficult. In addition, the piezoelectric substrate to which the photoresist film adheres is immersed in the palladium chloride solution, and thus deterioration of the palladium chloride solution is fast, and solution management is difficult.

In the partition made of a piezoelectric body described in JP 2012-35607 A, the corner portion between the upper end surface on the nozzle plate side and the side surface on the ink pressure chamber side is chamfered into the recessed shape. The electrode is formed on the entire exposed surface of the partition, and next, the electrode on the upper end surface of the partition is removed by a technique such as polishing or laser irradiation. Therefore, an angular electrode is exposed to an upper end of the recessed portion, and is lacked in the middle of the assembly step, and becomes a cause to decrease the manufacturing yield.

SUMMARY OF THE INVENTION

A liquid jet head of the present invention includes a partition separating adjacent grooves, a lower substrate fixing a lower portion of the partition, and an upper substrate installed on an upper end surface of the partition, wherein the partition includes an electrode layer on a surface lower than the upper end surface, the electrode layer includes an outer surface approximately perpendicular to the upper end surface, and the outer surface continues to the upper end surface through a first convex curved surface curving outward.

Further, a film thickness of the electrode layer becomes gradually thinner from the outer surface toward the upper end surface.

Further, the partition includes an inner surface approximately perpendicular to the upper end surface, and a second convex curved surface curving outward and connecting the inner surface and the upper end surface.

Further, a width of the first convex curved surface in an array direction into which a plurality of the grooves is arrayed falls within a range of 0.4 to 15 μm, and a width of the first convex curved surface in an up and down direction perpendicular to the array direction falls within a range of 0.4 to 10 μm.

A method of manufacturing a liquid jet head of the present invention includes a photosensitive resin layer forming step of installing a photosensitive resin layer on a surface of a polarized piezoelectric substrate, a groove forming step of forming a groove in the piezoelectric substrate, an etching step of etching an exposed surface of the piezoelectric substrate, a surface treatment step of applying surface treatment to the exposed surface of the piezoelectric substrate, a photosensitive resin layer removing step of removing the photosensitive resin layer from the surface of the piezoelectric substrate, and an electroless plating step of forming an electrode film on the surface of the piezoelectric substrate by electroless plating.

Further, the surface treatment step includes a first surface treatment step carried out before the photosensitive resin layer removing step, and a second surface treatment step carried out before the electroless plating step.

Further, the first surface treatment step is a step of immersing the exposed surface of the piezoelectric substrate into a colloidal solution of Sn and Pd, and the second surface treatment step is a step of applying acid treatment to the exposed surface of the piezoelectric substrate.

Further, the first surface treatment step is a step of causing Sn to adhere to the exposed surface of the piezoelectric substrate, and the second surface treatment step is a step of causing Pd to adhere to the exposed surface of the piezoelectric substrate.

A liquid jet device of the present invention includes the above-described liquid jet head, a moving mechanism configured to relatively move the liquid jet head and a recording medium, a liquid supply pipe configured to supply a liquid to the liquid jet head, and a liquid tank configured to supply the liquid to the liquid supply pipe.

The liquid jet head of the present invention includes a partition separating adjacent grooves, a lower substrate fixing a lower portion of the partition, and an upper substrate installed on an upper end surface of the partition, wherein the partition includes an electrode layer on a surface lower than the upper end surface, the electrode layer includes an outer surface approximately perpendicular to the upper end surface, and the outer surface continues to the upper end surface through a first convex curved surface curving outward. Accordingly, an end portion of the electrode layer is less easily separated, and a decrease in a manufacturing yield due to separated electrode dust can be prevented.

DETAILED DESCRIPTION

First Embodiment

Figure 1A:
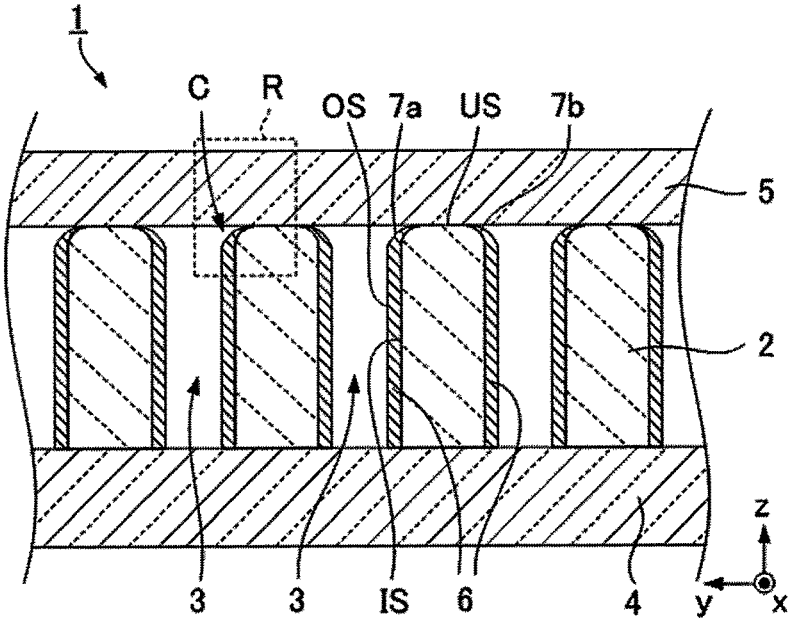
FIGS. 1A and 1B are sectional schematic views of a liquid jet head according to a first embodiment of the present invention.
Figure 1B:
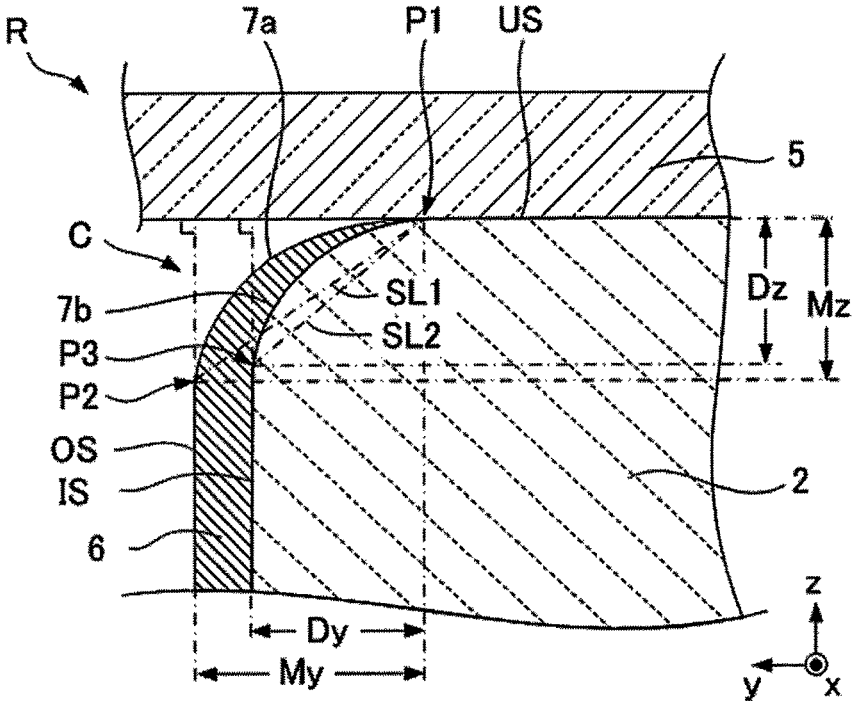

FIGS. 1A and 1B are sectional schematic views of a liquid jet head 1 according to a first embodiment of the present invention. FIG. 1A is a partial sectional schematic view of the liquid jet head 1, and FIG. 1B is an enlarged view of a region R including a corner portion C. Note that, in the description below, an up and down direction (±z direction) is unrelated to a gravity direction when the liquid jet head 1 is actually used.

As illustrated in FIGS. 1A and 1B, the liquid jet head 1 includes partitions 2 that separate adjacent grooves (passages) 3, a lower substrate 4 that fixes a lower portion of the partitions 2, and an upper substrate 5 installed on an upper end surface US of the partitions 2. The partition 2 includes an electrode layer 6 on a surface lower than (in a −z direction of) the upper end surface US. The electrode layer 6 includes an outer surface OS approximately perpendicular to the upper end surface US. The outer surface OS continues to the upper end surface US through a first convex curved surface 7*a* curving outward. An external surface that connects the upper end surface US and the outer surface OS forms the first convex curved surface 7*a* curving outward. Therefore, an upper end surface of the electrode layer 6 is less easily separated, and a decrease in a manufacturing yield due to separated electrode dust can be prevented.

Specific description will be given. For the partition 2, piezoelectric material made of lead zirconate titanate (PZT) ceramic material can be used. For example, piezoelectric material obtained by layering and gluing two PZT ceramics to which polarization processing is applied in an up direction and in a down direction (±z directions) can be used. A large number of the partitions 2 are arrayed in a y direction across the grooves 3. The lower substrate 4 fixes the lower portions of the partitions 2. For example, the same piezoelectric material as the partition 2 can be used for the lower substrate 4. The upper substrate 5 is fixed to the upper end surface US of the partition 2 with an adhesive, and the same piezoelectric material as the partition 2 can be used for the upper substrate 5, for example. The groove 3 is surrounded by the two partitions 2, the lower substrate 4, and the upper substrate 5, and configures a discharge groove or a non-discharge groove. The electrode layer 6 is installed on a surface lower than the upper end surface US of the partition 2 and reaching the lower substrate 4. The height of the partition 2 in the up and down direction is 300 to 400 μm. The thickness of the partition 2 in the array direction (y direction) and the width of the groove 3 in the array direction are 30 to 100 μm. The width of the partition 2 and the width of the groove 3 in a front direction (x direction) on the paper surface is 1 to 5 mm.

The electrode layer 6 can be formed by a plating method, for example. By applying a drive voltage to the two electrode layers 6 that sandwich the partition 2, the partition 2 is deformed into a dogleg shape, and generates a pressure wave to a liquid filled in the groove 3. This pressure wave reaches a nozzle hole (not illustrated) communicating into the groove 3, and droplets are discharged. Note that a liquid chamber communicating into the groove 3 can be formed in the upper substrate 5 or the lower substrate 4, and the upper substrate 5 or the lower substrate 4 can be used as a cover plate. Further, a nozzle hole communicating into the groove 3 can be formed in the upper substrate 5 or the lower substrate 4, and the upper substrate 5 or the lower substrate 4 can be used as a nozzle plate. Further, the partition 2 and the lower substrate 4 can be configured from one sheet of piezoelectric substrate. That is, a large number of grooves 3 may be formed in a surface of an upper portion of one sheet of piezoelectric substrate, the piezoelectric substrate between the groove 3 and the groove 3 may be used as the partition 2, and the piezoelectric substrate lower than the partition 2 may be used as the lower substrate 4.

The electrode layer 6 includes the outer surface OS approximately perpendicular to the upper end surface US, and the outer surface OS continues to the upper end surface US through the first convex curved surface 7*a* curving outward. The upper end surface US and the first convex curved surface 7*a* are connected at a connection point P1, and the first convex curved surface 7*a* and the outer surface OS are connected at a connection point P2. Note that FIG. 1B illustrates a cross section in a yz plane made by the y direction that is the array or row direction of the grooves 3 and the z direction that is the up and down direction. When considering an x direction perpendicular to the yz plane, the connection points P1 and P2 can be regarded as lines extending in the x direction, and these lines are positioned in or near a region where the electrode layer 6 in the x direction is formed. The first convex curved surface 7*a* is positioned outside a straight line SL1 that connects the connection point P1 and the connection point P2 in cross section on the yz plane. The first convex curved surface 7*a* is not necessarily in an arc shape in cross section on the yz plane and may have unevenness. However, the first convex curved surface 7*a* does not have a portion positioned inside the straight line SL1, and has a curved surface shape without an angular protrusion. The thickness of the electrode layer 6 in the outer surface OS is favorably 0.2 to 5 μm. If the electrode layer 6 is thinner than 0.2 μm, resistance is high, and if the electrode layer 6 is thicker than 5 μm, internal stress is large and the electrode layer 6 easily comes off.

The partition 2 includes an inner surface IS approximately perpendicular to the upper end surface US, and a second convex curved surface 7*b* curving outward and connecting the inner surface IS and the upper end surface US. The upper end surface US and the second convex curved surface 7*b* are connected at the connection point P1, and the second convex curved surface 7*b* and the inner surface IS are connected at a connection point P3. When considering the x direction, the connection point P1 and the connection point P3 can be regarded as lines extending in the x direction, and these lines are positioned in a region where the partition 2 in the x direction perpendicular to the yz plane is formed. The second convex curved surface 7*b* is positioned outside a straight line SL2 that connects the connection point P1 and the connection point P3 in cross section on the yz plane. The second convex curved surface 7*b* is not necessarily in an arc shape on the yz plane and may have unevenness. However, the second convex curved surface 7*b* does not have a region positioned inside the straight line SL2.

The width of the first convex curved surface 7*a* in the y direction on the yz plane, that is, an interval My between the connection point P1 and the connection point P2 in the y direction favorably falls in a range of 0.4 to 15 μm. If the interval My is smaller than 0.4 μm, the thickness of the electrode layer 6 becomes thin and resistance becomes large. If the interval My is made larger than 15 μm, the interval My needs to be made larger than 5 μm by 10 μm or more, 5 μm being the favorable film thickness of the electrode layer 6. However, it is difficult to form, by an etching method described below, the width of the second convex curved surface 7*b* in the y direction on the yz plane to be larger than 10 μm, that is, an interval Dy between the connection point P1 and the connection point P3 in the y direction to be larger than 10 μm, and another method such as a grinding method needs to be used and the manufacturing method becomes complicated. Therefore, it is favorable to form the interval My of the first convex curved surface 7*a* to be smaller than 15 μm. The width of the first convex curved surface 7*a* in the z direction (up and down direction) on the yz plane, that is, an interval Mz between the connection point P1 and the connection point P2 in the z direction favorably falls in a range of 0.4 to 10 μm. If the interval Mz is smaller than 0.4 μm, the electrode layer 6 becomes angular and easily comes off in the middle of work, and if the interval Mz is larger than 10 μm, the forming method becomes difficult. The above requirement of the first convex curved surface 7*a* is satisfied throughout the region in the x direction where the electrode layer 6 is formed.

The width of the second convex curved surface 7*b* in the y direction on the yz plane, that is, an interval Dy between the connection point P1 and the connection point P2 in the y direction favorably does not exceed 10 μm. If the interval Dy is made larger than 10 μm, the manufacturing method becomes complicated as described above. For similar reasons, the width of the second convex curved surface 7*b* in the z direction on the yz plane, that is, an interval Dz between the connection point P1 and the connection point P3 in the z direction favorably does not exceed 10 μm. If the interval Dz is made larger than 10 μm, the manufacturing method becomes complicated. The above requirement of the second convex curved surface 7*b* is satisfied throughout the region in the x direction where the electrode layer 6 is formed.

(Modification)

Figure 2A:
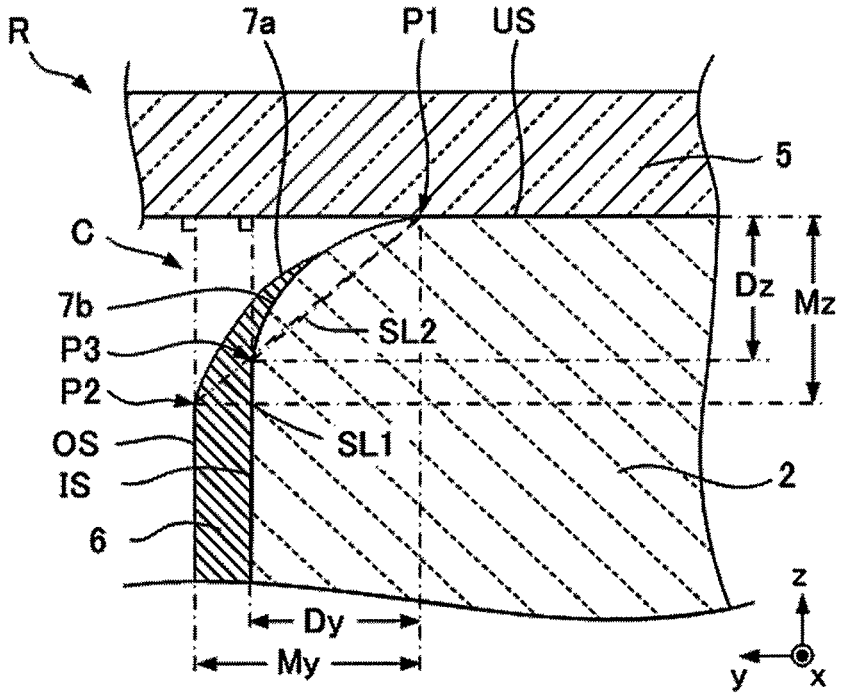
FIGS. 2A and 2B are enlarged views of a region R of a liquid jet head according to a modification of the first embodiment of the present invention.
Figure 2B:
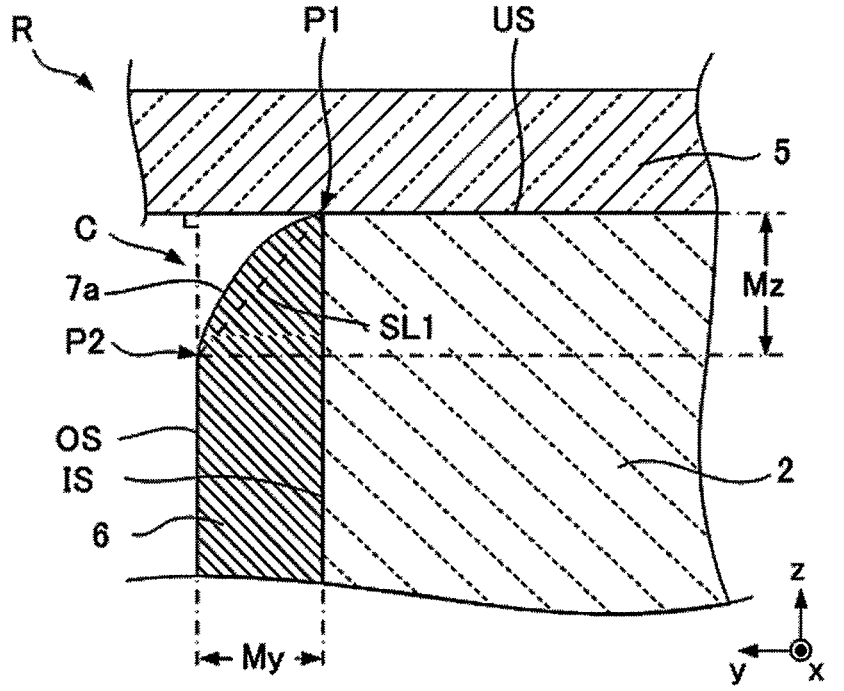

FIGS. 2A and 2B are enlarged views of a region R of a liquid jet head 1 according to a modification of the first embodiment of the present invention. FIG. 2A is an enlarged view of a region R of a liquid jet head 1 according to a first modification. In the first modification, an upper end surface of an electrode layer 6 does not reach an upper end surface US of a partition 2. Other configurations are similar to those of the first embodiment. FIG. 2B is an enlarged view of a region R of a liquid jet head 1 according to a second modification. In the second modification, a second convex curved surface 7*b* is not included between an inner surface IS and an upper end surface US of a partition 2. Both of the first and second modifications are included in the scope of the present invention. The same portion or a portion having the same function is denoted with the same reference sign.

As illustrated in FIG. 2A, on a first convex curved surface 7*a*, a surface of the electrode layer 6 and a surface of the partition 2 smoothly continue. Therefore, in a second convex curved surface 7*b* of the partition 2, an upper portion other than the upper end surface of the electrode layer 6 overlaps with the first convex curved surface 7*a*. In this case, the first convex curved surface 7*a* does not necessarily have an arc shape in cross section on a yz plane and may have unevenness. However, the first convex curved surface 7*a* does not have a portion positioned inside a straight line SL1, and has a curved surface shape without an angular protrusion. Others are similar to the first embodiment, and thus description is omitted.

As illustrated in FIG. 2B, in the partition 2, the inner surface IS and the upper end surface US are approximately perpendicular to each other, and no second convex curved surface 7*b* is included. In this case, the first convex curved surface 7*a* does not necessarily have an arc shape in cross section on a yz plane and may have unevenness. However, the first convex curved surface 7*a* does not have a portion positioned inside a straight line SL1, and has a curved surface shape without an angular protrusion. An interval My of the first convex curved surface 7*a* in a y direction favorably falls in a range of 0.4 to 5 μm. Other configurations are similar to those of the first embodiment, and thus description is omitted,

Second Embodiment

Figure 3:
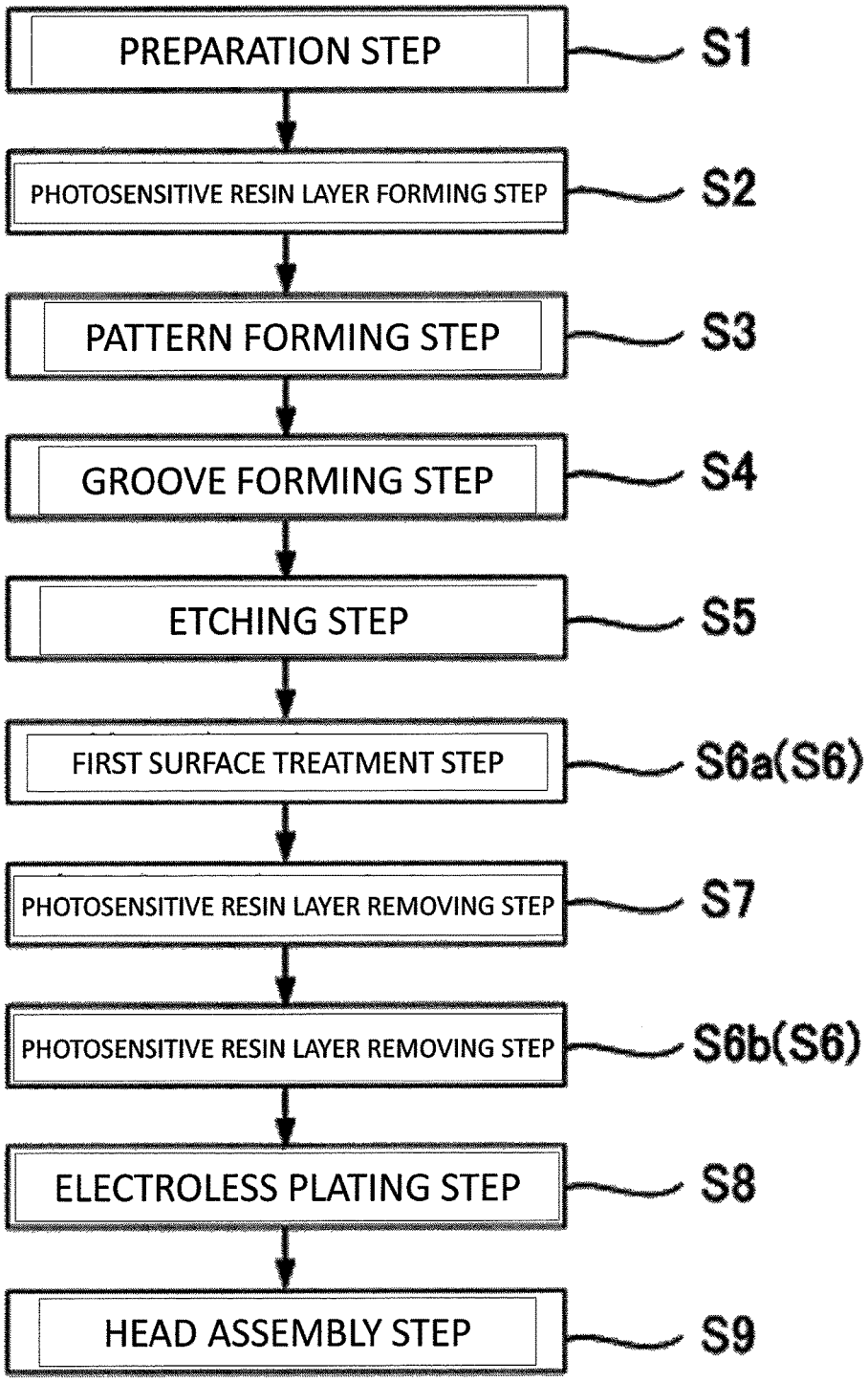
FIG. 3 is a process diagram illustrating a method of manufacturing a liquid jet head according to a second embodiment of the present invention.

FIG. 3 is a process diagram illustrating a method of manufacturing a liquid jet head 1 according to a second embodiment of the present invention. FIGS. 4A to 4E and FIGS. 5F to 5H are sectional schematic views for describing the method of manufacturing a liquid jet head 1 according to the second embodiment of the present invention. FIG. 6 is a schematic exploded perspective view of the liquid jet head 1 manufactured by the manufacturing method according to the second embodiment of the present invention. The same portion or a portion having the same function is denoted with the same reference sign.

The method of manufacturing the liquid jet head 1 of the present invention includes a photosensitive resin layer forming step S2, a groove forming step S4, an etching step S5, a surface treatment step S6, a photosensitive resin layer removing step S7, and an electroless plating step S8. In the photosensitive resin layer forming step S2, a photosensitive resin layer 12 is installed on a surface of a polarized piezoelectric substrate 11. Next, in the groove forming step S4, grooves 3 are formed in a piezoelectric substrate 11, and a partition 2 made of the piezoelectric substrate 11 is formed between the groove 3 and the groove 3. Next, in the etching step S5, an exposed surface of the piezoelectric substrate 11 is etched, and an upper end surface US and an inner surface IS approximately perpendicular to the upper end surface US of the partition 2 are connected, so that a second convex curved surface 7*b* curving outward is formed.

Next, in a first surface treatment step S6*a* in the surface treatment step S6, for example, surface treatment is applied to the surface of the piezoelectric substrate 11, in which colloidal particles of Sn and Pd, or Sn adheres to the surface. Next, in the photosensitive resin layer removing step S7, the photosensitive resin layer 12 is removed from the surface of the piezoelectric substrate 11. Next, in a second surface treatment step S6*b* in the surface treatment step S6, for example, acid treatment or surface treatment in which Pd adheres to the surface is applied to the surface of the piezoelectric substrate 11. Next, in the electroless plating step S8, an electrode layer 6 is formed on the surface of the piezoelectric substrate 11 by electroless plating. Accordingly, burr does not occur in the electrode layer 6 formed by an electroless plating method, and an end portion of the electrode layer 6 is less easily separated. Therefore, a decrease in a manufacturing yield due to the burr or dust made by a separated electrode is prevented.

Figure 4A:
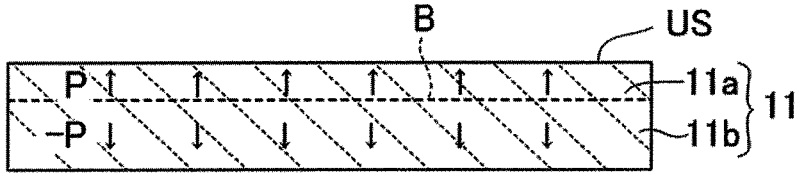
FIGS. 4A to 4E are sectional schematic views for describing the method of manufacturing a liquid jet head according to the second embodiment of the present invention.

Hereinafter, description will be specifically given. In a preparation step S1, the piezoelectric substrate 11 is prepared as illustrated in FIG. 4A. As the piezoelectric substrate 11, a PZT ceramic plate on which polarization processing is applied in a normal direction of a substrate surface can be used. For example, a chevron-type piezoelectric substrate 11 in which a piezoelectric substrate 11*a* having polarization P in the normal direction and a piezoelectric substrate 11*b* having polarization (−P) in an opposite direction are laminated and bonded at a position of a polarization boundary B. Note that the present invention is not limited to the chevron-type piezoelectric substrate 11.

Figure 4B:
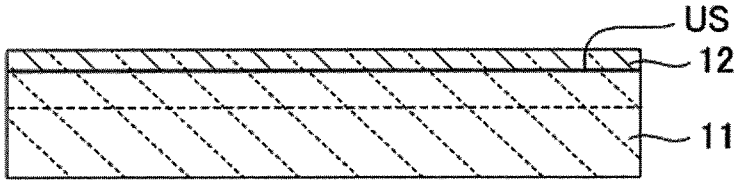

Next, in the photosensitive resin layer forming step S2, as illustrated in FIG. 4B, the photosensitive resin layer 12 is installed on the surface of the piezoelectric substrate 11. A resist film can be used as the photosensitive resin layer 12. The photosensitive resin layer 12 can be obtained by laminating a film-like resist on the surface of the piezoelectric substrate 11. Alternatively, the photosensitive resin layer 12 may be obtained by applying the resist on the surface of the piezoelectric substrate 11 with a dispenser or a coater and drying the surface. The film thickness of the photosensitive resin layer 12 is in a range of 20 to 50 μm.

Figure 4C:
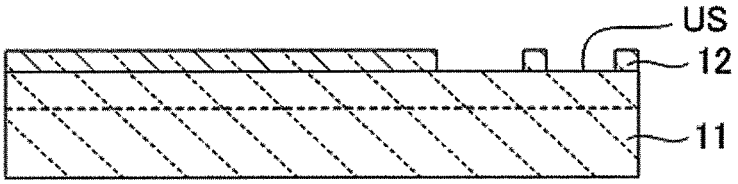

Next, in a pattern forming step S3, as illustrated in FIG. 4C, a pattern of the photosensitive resin layer 12 is formed.

The photosensitive resin layer 12 is removed from a region where an electrode terminal or electrode wiring for electrical connection with an external drive circuit is formed, by photolithography. Note that the pattern forming step S3 can be omitted if forming a groove pattern or an electrode pattern on the upper end surface US of the piezoelectric substrate 11 is not necessary.

Figure 4D:
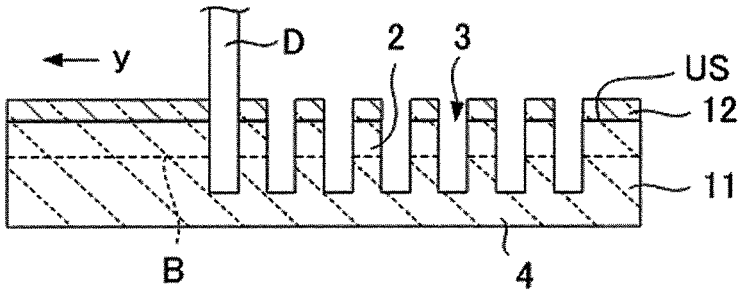

Next, in the groove forming step S4, as illustrated in FIG. 4D, the partition 2 is formed between the adjacent grooves 3 by grinding the upper end surface US of the piezoelectric substrate 11 using a dicing blade D or a diamond cutter to form a plurality of the grooves 3. Note that FIG. 4D illustrates a cross section different from FIG. 4C. FIG. 4C illustrates a cross section of the region where an electrode terminal or electrode wiring is installed, and FIG. 4D illustrates a cross section of a region where a large number of the grooves 3 is arrayed. FIG. 4E and FIGS. 5A to 5C similarly illustrate cross sections of the region where a large number of the grooves 3 is arrayed. The width of the groove 3 and the width of the partition 2 in the array direction (y direction) are 30 to 100 μm, and the depth of the groove 3 from the upper end surface US is 300 to 400 μm, and the width of the groove 3 and the width of the partition 2 in a front direction (x direction) on the paper surface are 1 to 5 mm. In a case of using the chevron-type piezoelectric substrate 11, the position of the polarization boundary B is set to approximately ½ the depth of the groove 3. Two hundreds or more grooves 3 are formed.

Figure 4E:
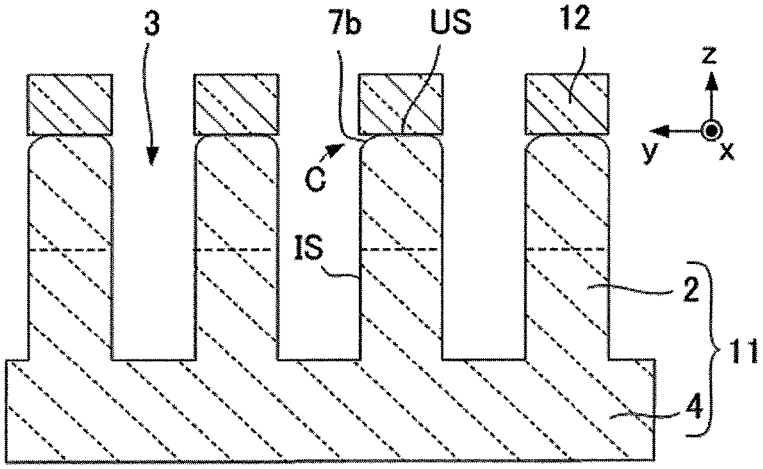

Next, in the etching step S5, as illustrated in FIG. 4E, the exposed surface of the piezoelectric substrate 11 including the partition 2 is etched. To be specific, the exposed surface of the partition 2 is etched. In a case of using the PZT ceramics as the piezoelectric substrate 11, the exposed surface of the partition 2 is immersed in an ammonium fluoride aqueous solution having the concentration of 1.5 wt % or less for a predetermined time. In addition to the etching of the exposed surface of the partition 2 with the etching solution, the etching solution enters between the photosensitive resin layer 12 and the upper end surface US of the partition 2, and a corner portion C between the upper end surface US and the inner surface IS of the partition 2 is etched, so that the second convex curved surface 7*b* is formed. The second convex curved surface 7*b* connects the upper end surface US of the partition 2 and the inner surface IS approximately perpendicular to the upper end surface US. The etching is softly (lightly) carried out so that occurrence of cracks in the partition 2 and drop-off of crystal grains are prevented. The width of the second convex curved surface 7*b* in the array direction (y direction) of the grooves 3 and the width of the second convex curved surface 7*b* in the up and down direction (z direction), on the yz plane made by the array direction of the grooves 3 and the up and down direction, are favorably up to 10 μm. If the widths are formed larger than 10 μm, cracks may be caused in the partition 2 or crystal grains may drop off.

Figure 5A:
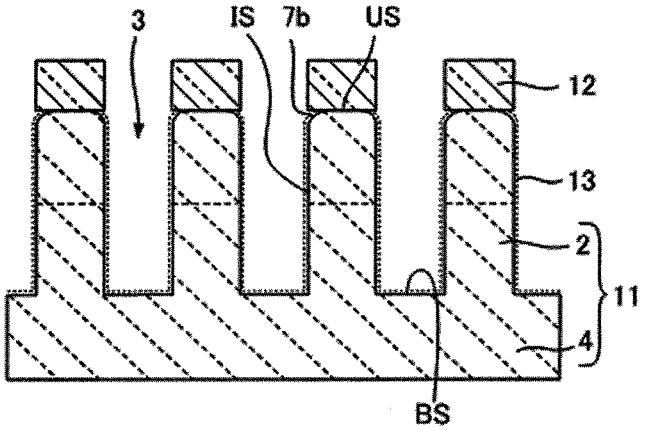
FIGS. 5A to 5C are sectional schematic views for describing the method of manufacturing a liquid jet head according to the second embodiment of the present invention.
Figure 6:
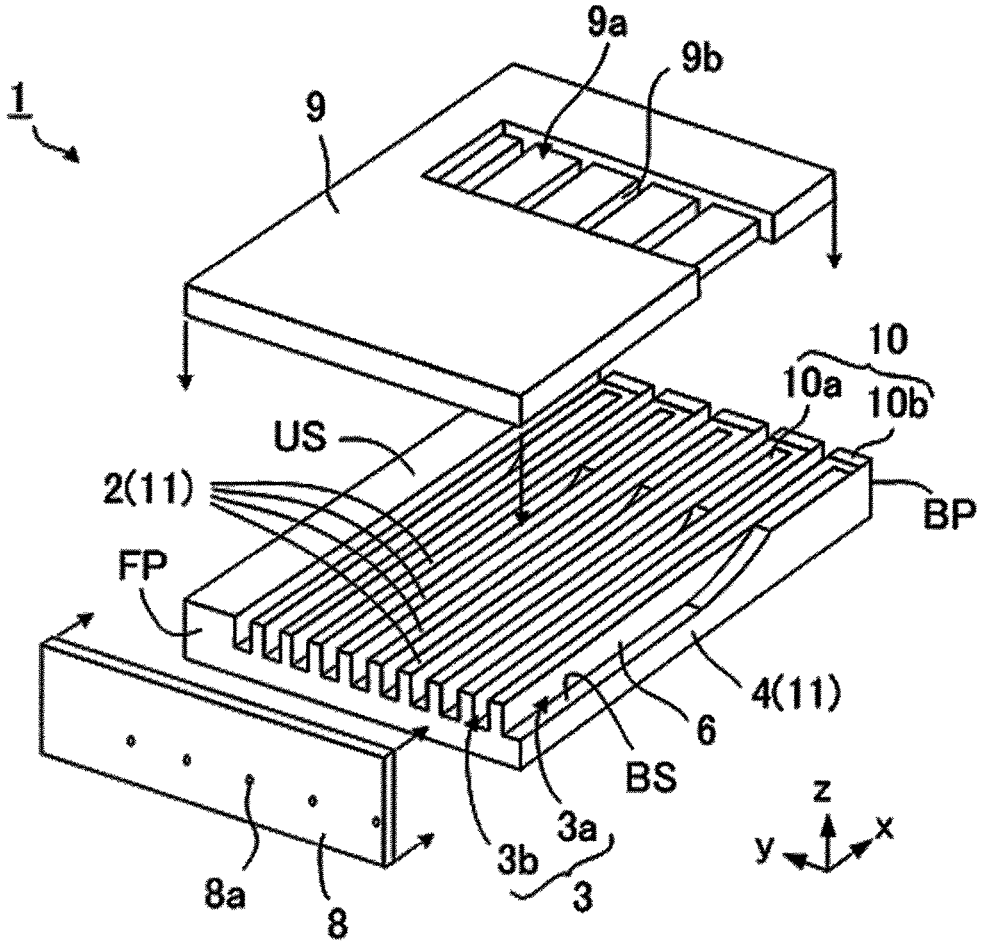
FIG. 6 is a schematic exploded perspective view of a liquid jet head manufactured by the method of manufacturing a liquid jet head according to the second embodiment of the present invention.

Next, in the first surface treatment step S6*a*, as illustrated in FIG. 5A, the exposed surface of the piezoelectric substrate 11 including the partition 2 is immersed in the colloidal solution of Sn and Pd, and the colloidal particles of Sn and Pd adhere to the exposed surface. To be specific, colloidal particles 13 adhere to the inner surface IS and a bottom surface of the groove 3. The colloidal solution enters between the photosensitive resin layer 12 and the second convex curved surface 7*b*, and the colloidal particles 13 also adhere to the second convex curved surface 7*b*.

Figure 5B:
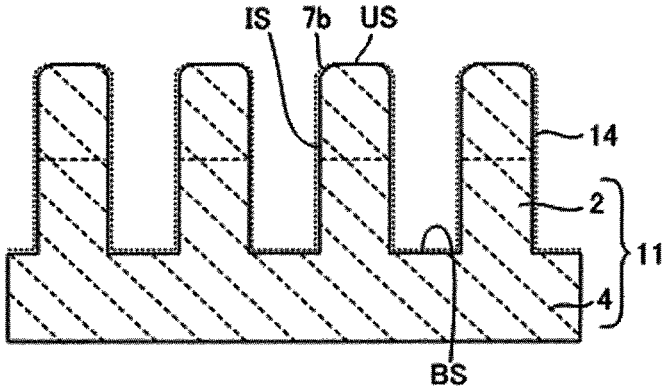

Next, in the photosensitive resin layer removing step S7, as illustrated in FIG. 5B, the photosensitive resin layer 12 is removed from the surface of the piezoelectric substrate 11 including the partition 2. To be specific, the photosensitive resin layer 12 is dissolved or separated by an alkaline solution such as a sodium hydroxide solution, an organic solvent such as N-methylpyrrolidone (NMP), or an alcohol solution such as ethanol, and is removed from the upper end surface US of the partition 2. Since the photosensitive resin layer 12 is not coated with an electrode material and the like, the photosensitive resin layer 12 can be easily removed. Next, second surface treatment step S6*b*, the acid treatment is applied to the exposed surface of the piezoelectric substrate 11. For example, the exposed surface of the piezoelectric substrate 11 is immersed in a hydrochloric acid solution, and Sn is removed from the exposed surface, and metal Pd is deposited on the exposed surface. Metal Pd functions as a plating catalyst 14.

Figure 5C:
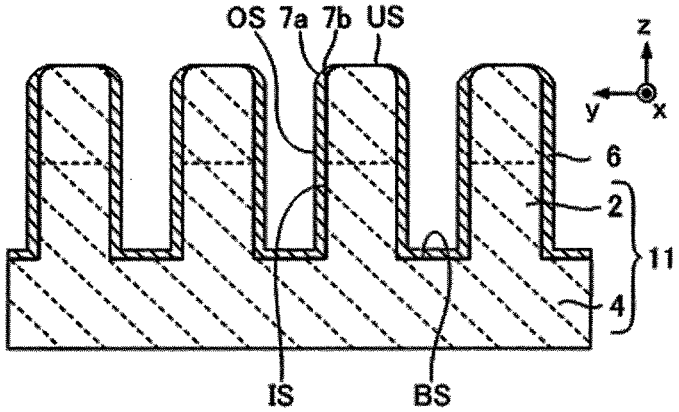

Next, in the electroless plating step S8, as illustrated in FIG. 5C, the electrode layer 6 is formed on the surface of the piezoelectric substrate 11 including the partition 2 by the electroless plating. To be specific, the electrode layer 6 is formed on the inner surface IS and the bottom surface BS of the groove 3 and the second convex curved surface 7*b* to which the plating catalyst 14 adheres by the electroless plating. The electrode layer 6 can be formed of Ni, Cu, Au, Ag, or the like. For example, the piezoelectric substrate 11 including the partition 2 is immersed in a Ni plating solution, and the electrode layer 6 is formed on the surface to which the plating catalyst adheres while swinging the piezoelectric substrate 11. The piezoelectric substrate 11 is swung so that hydrogen generated at the time of deposition of the electrode layer 6 is prevented from adhering to the groove 3. The thickness of the electrode layer 6 favorably falls in a range of 0.2 to 5 μm. If the electrode layer 6 is thinner than 0.2 μm, electrical resistance becomes high, and if the electrode layer 6 is thicker than 5 μm, the internal stress of the electrode layer 6 becomes high and the electrode becomes more likely to come off.

The electrode layer 6 is formed on the bottom surface BS of the groove 3, the inner surface IS of the partition 2, and the second convex curved surface 7*b* to which the plating catalyst 14 adheres, and the upper end surface US (the region of the upper end surface US from which the photosensitive resin layer 12 is removed, as illustrated in FIG. 4C), and the electrode layer 6 is not formed on the upper end surface US of the partition 2 to which the plating catalyst 14 does not adhere. The electrode layer 6 includes the outer surface OS approximately perpendicular to the upper end surface US of the partition 2, and the outer surface OS continues to the upper end surface US through the first convex curved surface 7*a* curving outward. The film thickness of the electrode layer 6 gradually becomes thinner from the outer surface OS toward the upper end surface US. The width of the first convex curved surface 7*a* in the y direction on the yz plane favorably falls in a range of 0.4 to 15 μm. If the width of the y direction is smaller than 0.4 μm, the thickness of the electrode layer 6 becomes thin and resistance becomes large. Further, since the favorable film thickness of the electrode layer 6 is up to 5 μm, and the favorable width of the second convex curved surface 7*b* in the y direction is up to 10 μm, the width of the first convex curved surface 7*a* in the y direction is favorably 15 μm or less. Further, the width of the first convex curved surface 7*a* in the z direction favorably falls in a range of 0.4 to 10 μm. If the width in the z direction is smaller than 0.4 μm, the electrode layer 6 becomes angular and easily comes off in the middle of work, and if the width in the z direction is larger than 10 μm, the forming method becomes difficult.

Next, in a head assembly step S9, as illustrated in FIG. 6, a cover plate 9 is glued to the upper end surface US of the piezoelectric substrate 11 including the partition 2 with an adhesive, and a nozzle plate 8 is glued to front end surfaces of the piezoelectric substrate 11 and the cover plate 9 with an adhesive, so that a liquid jet head 1 is configured.

As described above, the electrode layer 6 is formed on the second convex curved surface 7*b*, in addition to the inner surface IS of the partition 2. Therefore, the electrode layer 6 is less easily separated, and a decrease in a manufacturing yield due to separated electrode dust can be prevented. Further, after the photosensitive resin layer 12 is removed, the electrode layer 6 is formed by the electroless plating. Therefore, a fine pattern of the electrode layer 6 can be easily formed. Unlike the present invention, for example, after the first surface treatment step S6*a*, the second surface treatment step S6*b* is carried out and the plating catalyst adheres to the exposed surface of the piezoelectric substrate 11, next, the electroless plating step S8 is carried out and the electrode material is deposited on the exposed surface of the partition 2 and the surface of the photosensitive resin layer 12, next, the photosensitive resin layer 12 and the electrode material thereon are removed by a lift-off method, and the electrode layer 6 can be formed on the inner surface IS and the second convex curved surface 7*b* of the partition 2. However, the photosensitive resin layer 12 has a water-repellent property. Therefore, the electroless plating solution less easily enter a gap between the photosensitive resin layer 12 and the upper end surface US, and burr remains on the upper end surface of the electrode layer 6 or the upper end surface becomes angular and the electrode dust is more likely to occur. Further, the electrode material is deposited on the photosensitive resin layer 12, and thus removal of the photosensitive resin layer 12 becomes difficult.

Note that, in the present embodiment, a catalyst accelerator method is used, in which the exposed surface of the piezoelectric substrate 11 is immersed in the colloidal solution of Sn and Pd in the first surface treatment step S6*a*, and the acid treatment is applied to the exposed surface of the piezoelectric substrate 11 and metal Pd is deposited on the surface in the second surface treatment step S6*b*. Instead, a sensitizer-activator method can be used, in which Sn adheres to the exposed surface of the piezoelectric substrate 11 in the first surface treatment step S6*a*, and Sn adhering to the exposed surface of the piezoelectric substrate 11 is replaced with metal Pd in the second surface treatment step S6*b*. To be specific, in the first surface treatment step S6*a*, the piezoelectric substrate 11 including the partition 2 is immersed in a stannous chloride solution. Then, after the photosensitive resin layer removing step S7, the piezoelectric substrate 11 is immersed in a palladium chloride aqueous solution in the second surface treatment step S6*b*. Metal Pd is deposited on the surface of the piezoelectric substrate 11 to which tin chloride adheres, by an oxidation-reduction reaction of tin chloride and palladium chloride.

In a case of using the sensitizer-activator method, the plating catalyst 14 and the electrode layer 6 can be formed on the inner surfaces (the bottom surface BS, the inner surface IS, and the second convex curved surface 7*b*) of the groove 3, and the upper end surface US of the partition 2 and the piezoelectric substrate 11 in an accurate pattern. Further, in the first surface treatment step S6*a*, Sn can adhere to the exposed surface of the piezoelectric substrate 11 without being affected by the water-repellent property of the photosensitive resin layer 12. Therefore, in the second surface treatment step S6*b*, the plating catalyst 14 can accurately adhere to the shape of the pattern of the photosensitive resin layer 12, and in the electroless plating step S8, an accurate pattern of the electrode layer 6 can be formed on the second convex curved surface 7*b* and the upper end surface US. Further, in the first surface treatment step S6*a*, the catalyst pretreatment substance (for example, stannous chloride in the stannous chloride solution) adhering to the surface of the photosensitive resin layer 12 is not brought to the catalyst providing solution (for example, the palladium chloride solution) in the second surface treatment step S6*b*. Therefore, a catalyst providing reaction of the catalyst providing solution is not advanced, and deterioration of the catalyst providing solution can be suppressed.

A configuration of the liquid jet head 1 illustrated in FIG. 6 will be described. The liquid jet head 1 includes the piezoelectric substrate 11, the cover plate 9 glued to the upper end surface US of the piezoelectric substrate 11, and the nozzle plate 8 glued to the front end surfaces of the cover plate 9 and the piezoelectric substrate 11. The piezoelectric substrate 11 includes alternately arrayed discharge grooves 3*a* and non-discharge grooves 3*b* on the upper end surface US. The discharge groove 3*a* is formed from a front end surface FP of the piezoelectric substrate 11 up to a rear end surface BP, and the non-discharge groove 3*b* is formed from the front end surface FP to the rear end surface BP. The electrode layer 6 deposited by the above method is installed on the side surfaces (the inner surfaces IS of the partitions 2) and the bottom surfaces BS of the discharge groove 3*a* and the non-discharge groove 3*b*. Note that the electrode layer 6 on one side surface (the inner surface IS of one partition 2) and the electrode layer 6 on the other side surface (the inner surface IS of the other partition 2) of the non-discharge groove 3*b* are electrically separated. For the electrical separation, after the electrode layer 6 is formed by the electroless plating step S8, the bottom surface of the non-discharge groove 3*b* is irradiated with laser light, and the electrode layer 6 on the bottom surface can be removed. The piezoelectric substrate 11 includes an individual terminal 10*b* on the end surface BP side in the rear of the upper end surface US, and a common terminal 10*a* on the front side of the individual terminal 10*b*. The individual terminal 10*b* electrically connects the electrode layers 6 on the discharge groove 3*a* side, of the adjacent two non-discharge grooves 3*b* across the discharge groove 3*a*. The common terminal 10*a* is electrically connected with the electrode layer 6 of the discharge groove 3*a*.

The cover plate 9 is glued to the upper end surface US of the piezoelectric substrate 11 such that the front end surface becomes flush with the front end surface FP of the piezoelectric substrate 11, and the common terminal 10*a* and the individual terminal 10*b* are exposed. The cover plate 9 includes a liquid chamber 9*a* on the rear side, and the liquid chamber 9*a* includes a slit 9*b* that penetrates from its bottom surface to the side of the piezoelectric substrate 11. The slit 9*b* allows the liquid chamber 9*a* and a rear end of the discharge groove 3*a* to communicate with each other, and allows a liquid to be supplied from the liquid chamber 9*a* to the discharge groove 3*a*. The nozzle plate 8 is glued to the front end surfaces of the piezoelectric substrate 11 and the cover plate 9. The nozzle plate 8 includes a nozzle hole 8*a*, and the nozzle hole 8*a* communicates with the discharge groove 3*a*.

The liquid jet head 1 is operated as follows. First, the liquid is supplied to the liquid chamber 9*a*, and the discharge groove 3*a* is filled with the liquid through the slit 9*b*. A drive signal is applied to the common terminal 10*a* and the individual terminal 10*b*, and both the partitions 2 sandwiching the discharge groove 3*a* are thickness-slip deformed. To be specific, both the partitions 2 are deformed in a direction into which the volume of the discharge groove 3*a* is increased, so that the liquid is drawn from the liquid chamber 9*a* to the discharge groove 3*a*. Next, both the partitions 2 are deformed in a direction into which the volume of the discharge groove 3*a* is decreased, and droplets are discharged through the nozzle hole 8*a*. Note that the liquid jet head 1 illustrated in FIG. 6 is an example. The method of manufacturing a liquid jet head of the present invention can be applied to a side shoot-type or a liquid circulation-type liquid jet head, in addition to an edge shoot-type liquid jet head.

Third Embodiment

Figure 7:
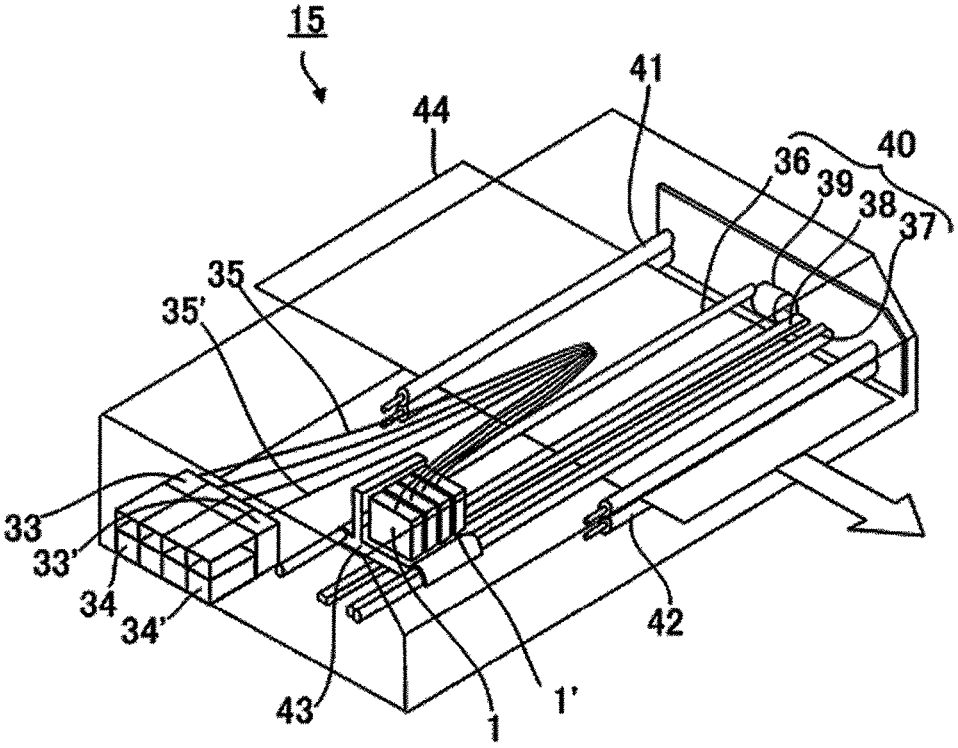
FIG. 7 is a schematic perspective view of a liquid jet device according to a third embodiment of the present invention.

FIG. 7 is a schematic perspective view of a liquid jet device 15 according to a third embodiment of the present invention. The liquid jet device 15 includes a moving mechanism 40 that reciprocates liquid jet heads 1 and 1', channel portions 35 and 35' through which the liquid is supplied to the liquid jet heads 1 and 1' and is discharged from the liquid jet heads 1 and 1', liquid pumps 33 and 33' communicating with the channel portions 35 and 35', and liquid tanks 34 and 34'. As the liquid jet head 1, 1', the liquid jet head 1 of the first embodiment or the liquid jet head 1 manufactured by the second embodiment described above is used.

The liquid jet device 15 includes a pair of conveying means 41 and 42 that conveys a recording medium 44 such as paper in a main scanning direction, the liquid jet heads 1 and 1' that discharge the liquid to the recording medium 44, a carriage unit 43 on which the liquid jet heads 1 and 1' are placed, the liquid pumps 33 and 33' that press and supply the liquid stored in the liquid tanks 34 and 34' to the channel portions 35 and 35', and the moving mechanism 40 that causes the liquid jet heads 1 and 1' to scan in a sub-canning direction perpendicular to the main scanning direction. A control unit (not illustrated) controls and drives the liquid jet heads 1 and 1', the moving mechanism 40, and the conveying means 41 and 42.

The pair of conveying means 41 and 42 includes a grid roller and a pinch roller extending in the sub-scanning direction, and being rotated while roller surfaces come in contact. The grid roller and the pinch roller are moved around axes by a motor (not illustrated), and the recording medium 44 sandwiched between the rollers is conveyed in the main scanning direction. The moving mechanism 40 includes a pair of guide rails 36 and 37 extending in the sub-scanning direction, the carriage unit 43 slidable along the pair of guide rails 36 and 37, an endless belt 38 connecting and moving the carriage unit 43 in the sub-scanning direction, and a motor 39 that rotates the endless belt 38 through a pulley (not illustrated).

The carriage unit 43 has the plurality of liquid jet heads 1 and 1' placed thereon, and discharges, for example, four types of droplets including yellow, magenta, cyan, and black. The liquid tanks 34 and 34' store liquids of corresponding colors, and supply the liquid to the liquid jet heads 1 and 1' through the liquid pumps 33 and 33' and the channel portions 35 and 35'. The liquid jet heads 1 and 1' respectively discharge the droplets of the colors according to a drive signal. By controlling the timing to discharge the liquids from the liquid jet heads 1 and 1', rotation of the motor 39 that drives the carriage unit 43, and a conveying speed of the recording medium 44, an arbitrary pattern can be recorded on the recording medium 44.

Note that the present embodiment refers to the liquid jet device 15 in which the moving mechanism 40 moves the carriage unit 43 and the recording medium 44 and recording is carried out. However, in place of the liquid jet device 15, a liquid jet device in which a carriage unit is fixed and a moving mechanism moves a recording medium in a two-dimensional manner may be employed. That is, the moving mechanism may just relatively move the liquid jet head and the recording medium.

What is claimed is:

1. A liquid jet head comprising:

a partition separating adjacent grooves;

a lower substrate fixing a lower portion of the partition; and an upper substrate installed on an upper end surface of the partition, wherein the partition includes an electrode layer on a surface lower than the upper end surface, the electrode layer includes an outer surface approximately perpendicular to the upper end surface, and the outer surface continues to the upper end surface through a first convex curved surface curving outward.

2. The liquid jet head according to claim 1, wherein, a width of the first convex curved surface in an array direction into which a plurality of the grooves are arrayed falls within a range of 0.4 to 15 μm, and a width of the first convex curved surface in an up and down direction perpendicular to the array direction falls within a range of 0.4 to 10 μm.

3. The liquid jet head according to claim 1, wherein the partition includes an inner surface approximately perpendicular to the upper end surface, and a second convex curved surface curving outward and connecting the inner surface and the upper end surface.

4. The liquid jet head according to claim 3, wherein, a width of the first convex curved surface in an array direction into which a plurality of the grooves are arrayed falls within a range of 0.4 to 15 μm, and a width of the first convex curved surface in an up and down direction perpendicular to the array direction falls within a range of 0.4 to 10 μm.

5. The liquid jet head according to claim 1, wherein a film thickness of the electrode layer becomes gradually thinner from the outer surface toward the upper end surface.

6. The liquid jet head according to claim 5, wherein, a width of the first convex curved surface in an array direction into which a plurality of the grooves are arrayed falls within a range of 0.4 to 15 μm, and a width of the first convex curved surface in an up and down direction perpendicular to the array direction falls within a range of 0.4 to 10 μm.

7. The liquid jet head according to claim 5, wherein the partition includes an inner surface approximately perpendicular to the upper end surface, and a second convex curved surface curving outward and connecting the inner surface and the upper end surface.

8. The liquid jet head according to claim 7, wherein, a width of the first convex curved surface in an array direction into which a plurality of the grooves are arrayed falls within a range of 0.4 to 15 μm, and a width of the first convex curved surface in an up and down direction perpendicular to the array direction falls within a range of 0.4 to 10 μm.

9. A liquid jet device comprising:

the liquid jet head according to claim 1;

a moving mechanism configured to relatively move the liquid jet head and a recording medium;

a liquid supply pipe configured to supply a liquid to the liquid jet head; and a liquid tank configured to supply the liquid to the liquid supply pipe.

10. A liquid jet head comprising:

a row of partitions spaced apart from one another in a row direction, each two adjacent partitions defining therebetween a passage;

a lower substrate fixing lower portions of the partitions and covering lower ends of the passages;

an upper substrate disposed on upper end surfaces of the partitions and covering upper ends of the passages; and an electrode layer formed on respective confronting surfaces of each two adjacent partitions, the electrode layer having an outer surface which includes a first convex curved surface that curves outward in a region at or near the upper end surface of the partition.

11. The liquid jet head according to claim 10; wherein a film thickness of the electrode layer becomes gradually thinner from the outer surface toward the upper end surface.

12. The liquid jet head according to claim 10; wherein each partition includes opposed inner surfaces approximately perpendicular to the upper end surface, and second convex curved surfaces curving outward and connecting the inner surface and the upper end surface.

13. The liquid jet head according to claim 10, wherein, a width of the first convex curved surface in the row direction is within a range of 0.4 to 15 μm, and a width of the first convex curved surface in an up and down direction perpendicular to the row direction is within a range of 0.4 to 10 μm.

14. A liquid jet device comprising:

the liquid jet head according to claim 10;

a moving mechanism configured to relatively move the liquid jet head and a recording medium;

a liquid supply pipe configured to supply a liquid to the liquid jet head; and a liquid tank configured to supply the liquid to the liquid supply pipe.

* * * * *